US008100349B2

(12) United States Patent
Matsumoto et al.

(10) Patent No.: US 8,100,349 B2
(45) Date of Patent: Jan. 24, 2012

(54) FUEL INJECTION DEVICE

(75) Inventors: Teppei Matsumoto, Obu (JP); Kouichi Mochizuki, Anjo (JP)

(73) Assignee: Denso Corporation, Kariya (JP)

( * ) Notice: Subject to any disclaimer, the term of this patent is extended or adjusted under 35 U.S.C. 154(b) by 480 days.

(21) Appl. No.: 12/434,867

(22) Filed: May 4, 2009

(65) Prior Publication Data

US 2009/0277978 A1 Nov. 12, 2009

(30) Foreign Application Priority Data

May 12, 2008 (JP) ..... 2008-124427

(51) Int. Cl.
*F02M 45/00* (2006.01)
*F02M 47/02* (2006.01)
*F02M 63/00* (2006.01)

(52) U.S. Cl. ..... 239/533.4; 239/88; 239/89; 123/447

(58) Field of Classification Search ..... 123/299, 123/446, 447, 467, 468; 239/533.1–533.9, 239/88–91

See application file for complete search history.

(56) References Cited

U.S. PATENT DOCUMENTS

| | | | | |
|---|---|---|---|---|
| 6,729,554 | B2 * | 5/2004 | Katsura et al. | 239/88 |
| 6,840,466 | B2 * | 1/2005 | Igashira et al. | 239/585.1 |
| 6,874,475 | B2 | 4/2005 | Katsura et al. | |
| 6,962,297 | B2 | 11/2005 | Kienzler et al. | |
| 7,118,046 | B2 | 10/2006 | Yoshimura et al. | |
| 7,635,093 | B2 * | 12/2009 | Stier | 239/102.2 |
| 2003/0116656 | A1 | 6/2003 | Hohl | |
| 2007/0001032 | A1 * | 1/2007 | Boecking | 239/533.3 |

FOREIGN PATENT DOCUMENTS

| | | |
|---|---|---|
| JP | 10-288116 | 10/1998 |
| JP | 11-022586 | 1/1999 |
| JP | 2002-257003 | 9/2002 |
| JP | 2004-519110 | 6/2004 |
| JP | 2004-225626 | 8/2004 |
| JP | 2005-48599 | 2/2005 |
| WO | WO 2006/134005 | 12/2006 |

OTHER PUBLICATIONS

Japanese Office Action dated Feb. 26, 2010, issued in corresponding Japanese Application No. 2008-124427, with English translation.

* cited by examiner

*Primary Examiner* — Jason Boeckmann
*Assistant Examiner* — Justin Jonaitis
(74) *Attorney, Agent, or Firm* — Nixon & Vanderhye PC

(57) ABSTRACT

A piston can reciprocate in a piston guide cylinder in an axial direction and has a cavity on a piezo driver side thereof. If the piezo driver is energized, a tip of a projecting section of a pushing member pushes a bottom wall of the piston defining the cavity. If fuel pressure of a pressure control chamber increases via a pressurization chamber and a communication passage due to pressurization by the piston, a needle moves in a valve-opening direction against a first compression coil spring. Since the piston has the cavity, a movable mass of the piston is reduced while securing axial length of a sliding section. Thus, fuel leak from the sliding section between the piston and the piston guide cylinder can be suppressed, and an inertial resistance caused in the piston can be reduced.

3 Claims, 5 Drawing Sheets

COMPARATIVE EXAMPLE

FUEL INJECTION DEVICE

CROSS REFERENCE TO RELATED APPLICATION

This application is based on and incorporates herein by reference Japanese Patent Application No. 2008-124427 filed on May 12, 2008.

BACKGROUND OF THE INVENTION

1. Field of the Invention

The present invention relates to a fuel injection device that performs injection supply of fuel to an internal combustion engine. In particular, the present invention relates to a fuel injection device that controls seating and separation of a valve member to and from a valve seat with pressurized fuel.

2. Description of Related Art

Conventionally, there is a known fuel injection device that pressurizes a fluid by driving a driver to separate a valve member from a valve seat, thereby injecting fuel (for example, refer to Patent document 1: US 2003/0116656 A1). There is also a publicly known fuel injection device structured such that a valve member lifts in a direction, in which the valve member separates from a valve seat, when fuel pressure of a fuel pressure control system is increased by a piston, thereby injecting the fuel from an injection hole communicating with a fuel passage.

In such the fuel injection device, fuel leak arises from a sliding section between the piston and a cylinder member since the fuel pressure control system is pressurized. In order to prevent the fuel leak, it is necessary to secure axial length of the sliding section. However, if the axial length of the sliding section is secured, the body size of the piston increases and the movable mass increases. Accordingly, an inertial resistance caused in the piston increases, leading to an energy loss.

SUMMARY OF THE INVENTION

It is an object of the present invention to provide a fuel injection device capable of reducing an energy loss.

According to an aspect of the present invention, a fuel injection device has a nozzle body, a valve member, a first biasing member, a cylinder member, a piston, a fuel pressure control system, a second biasing member, a driver and a pushing member. The nozzle body has an injection hole, a valve seat and a fuel passage communicating with the injection hole. The valve member blocks fuel flowing through the injection hole when the valve member is seated on the valve seat and allows the flow of the fuel when the valve member separates from the valve seat. The first biasing member biases the valve member in a valve-closing direction. The piston is capable of reciprocating in the cylinder member in an axial direction and has a cavity on the driver side. The fuel pressure control system has a pressure control chamber, which biases the valve member in a valve-opening direction when fuel pressure increases, and a pressurization chamber communicating with the pressure control chamber. The fuel in the pressurization chamber is pressurized by the piston. The second biasing member biases the piston in a direction decreasing the pressure of the pressurization chamber. The driver is capable of displacing in accordance with an energization amount. The pushing member pushes an inner wall of the piston defining the cavity in a direction increasing the pressure in the pressurization chamber by using the driving force of the driver.

Since the piston has the cavity, the movable mass is reduced while securing the axial length of the sliding section. Thus, the fuel leak from the sliding section between the piston and the cylinder member can be suppressed, and the inertial resistance caused in the piston can be reduced. Therefore, the energy loss can be reduced and the driving force of the driver can be used highly efficiently.

The piston is more apt to incline as a pushing position where the pushing member pushes the piston is more distant from the centroid of the piston on a side opposite from the injection hole. If the piston inclines, a sliding resistance increases and the energy loss increases. Therefore, it is desirable to adopt a following construction.

That is, according to another aspect of the present invention, in the fuel injection device, the pushing member pushes the piston at a position substantially coinciding with the centroid of the piston. Thus, the inclination of the piston can be inhibited. Accordingly, the energy loss accompanying the increase of the sliding resistance can be suppressed.

According to another aspect of the present invention, in the fuel injection device, the pushing member pushes the piston at a position on the injection hole side of the centroid of the piston. Thus, the inclination of the piston can be inhibited. Accordingly, the energy loss accompanying the increase of the sliding resistance can be suppressed.

Furthermore, it is desirable to adopt a following construction.

That is, according to another aspect of the present invention, in the fuel injection device, an accommodation member accommodates the driver inside the nozzle body, and a sealing member is provided to the accommodation member to isolate the driver and the pushing member from the fuel passage. Thus, the fuel can be prevented from entering the inside of the accommodation member and the sealing member and therefore the fuel can be prevented from entering the driver.

According to another aspect of the present invention, in the fuel injection device, an accommodation member accommodates the driver inside the nozzle body. A sealing member has a radially inner end attached to an outer wall of the pushing member and a radially outer end attached to the accommodation member, thereby isolating the driver from the fuel passage. Thus, the fuel can be prevented from entering the inside of the accommodation member and the sealing member and therefore the fuel can be prevented from entering the driver.

According to yet another aspect of the present invention, in the fuel injection device, the sealing member is a bellows or a diaphragm. Thus, the fuel can be prevented from entering the accommodation member.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Hereinafter, embodiments of the present invention will be described with reference to the drawings.

First Embodiment

Figure 1:
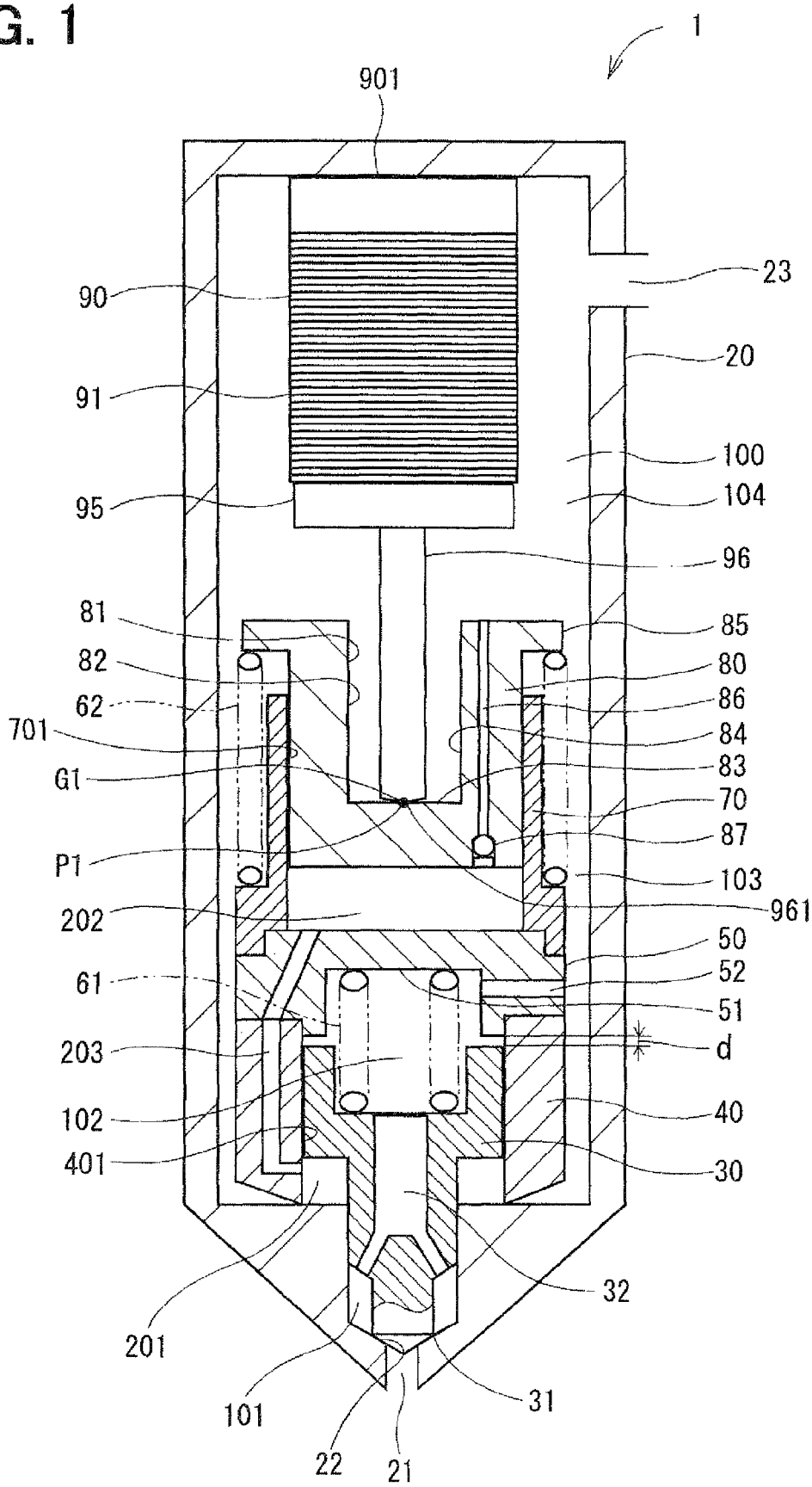
FIG. 1 is a schematic sectional diagram showing a fuel injection device according to a first embodiment of the present invention.

FIG. 1 shows a fuel injection device according to a first embodiment of the present invention. The fuel injection device 1 is fixed to each cylinder of a diesel engine, for example. The fuel injection device 1 injects high-pressure fuel, which is stored in a common rail in a pressure accumulation state, into each cylinder. The fuel injection device 1 has a nozzle body 20, a needle 30 as a valve member, a needle guide cylinder 40, a lid member 50, a piston guide cylinder 70 as a cylinder member, a piston 80, a piezo driver 90 as a driver, a pushing member 95 and the like.

The nozzle body 20 is formed in a cylindrical shape, and an injection hole 21 is formed in an end of the nozzle body 20. The injection hole 21 provides communication between an inner wall and an outer wall of the nozzle body 20. A fuel sump chamber 101 is formed on an inlet side of the injection hole 21. A valve seat 22 is formed on the inner wall of the nozzle body 20 between the fuel sump chamber 101 and the inlet of the injection hole 21. An inlet port 23 communicating with the common rail (not shown) is formed in the nozzle body 20. A fuel passage 100 is formed in the nozzle body 20. The fuel at pressure substantially equal to the pressure in the common rail is supplied to the fuel passage 100. The fuel sump chamber 101 constitutes a part of the fuel passage 100.

The needle 30, the needle guide cylinder 40, the lid member 50, the piston guide cylinder 70, the piston 80, the piezo driver 90, the pushing member 95 and the like are provided in the nozzle body 20. A back pressure chamber 102, a pressure control chamber 201, a pressurization chamber 202 and the like are formed in the nozzle body 20. The needle 30 is accommodated inside the nozzle body 20 such that the needle 30 can reciprocate therein. The needle 30 has a sealing section 31, which can be seated on the valve seat 22. If the sealing section 31 separates from the valve seat 22, the fuel sump chamber 101 communicates with the injection hole 21, and the fuel injection from the injection hole 21 is allowed. When the sealing section 31 is seated on the valve seat 22, the communication between the fuel passage 100 and the injection hole 21 is blocked, so the fuel injection from the injection hole 21 is stopped.

The needle guide cylinder 40 is formed substantially in a cylindrical shape. An end of the needle guide cylinder 40 contacts with the inner wall of the nozzle body 20 on the injection hole 21 side, and the other end of the needle guide cylinder 40 is blocked by the lid member 50. The lid member 50 is formed substantially in the shape of a disk and has a recess portion 51 on an end surface thereof on the needle guide cylinder 40 side. An outer peripheral wall of the needle 30 slidably contacts with an inner peripheral wall 401 of the needle guide cylinder 40. Thus, the needle 30 is guided by the needle guide cylinder 40 such that the needle 30 can reciprocate in an axial direction. When the needle 30 is seated on the valve seat 22, a gap of width d is formed between the needle 30 and the lid member 50. The needle 30 can reciprocate between a position where the needle 30 contacts with the valve seat 22 and a position where the needle 30 contacts with the lid member 50. That is, the maximum lift amount of the needle 30 is d. The pressure control chamber 201 substantially in an annular shape is defined by the outer wall of the needle 30, the inner peripheral wall of the needle guide cylinder 40 and the inner wall of the nozzle body 20.

The back pressure chamber 102 is defined by the end of the needle 30 on a side opposite from the injection hole 21, the lid member 50 and the inner peripheral wall of the needle guide cylinder 40. A passage 52 formed in the lid member 50 provides communication between the fuel passage 100 and the back pressure chamber 102. A first compression coil spring 61 as a first biasing member is accommodated in the back pressure chamber 102. An end of the first compression coil spring 61 contacts with the needle 30 and the other end of the first compression coil spring 61 contacts with the recess portion 51. The first compression coil spring 61 biases the needle 30 toward the valve seat 22, i.e., in a valve closing direction. The needle 30 is formed with a hollow 32 providing communication between the back pressure chamber 102 and the fuel sump chamber 101. Thus, the fuel flows from the back pressure chamber 102 into the fuel sump chamber 101 via the hollow 32.

The piston guide cylinder 70 is formed substantially in a cylindrical shape and is fixed to the lid member 50. An end of the piston guide cylinder 70 is blocked by the lid member 50. The piston 80 is slidably inserted in an inner peripheral wall 701 of the piston guide cylinder 70. The piston 80 is formed substantially in a cylindrical shape having a bottom. A cavity 84 is formed by an inner wall 81 of the piston 80 consisting of a side wall 82 and a bottom wall 83. The cavity 84 opens on a side opposite from the lid member 50. An end of the side wall 82 opposite from the lid member 50 has an annular flange section 85 extending radially outward. The outer peripheral wall of the piston 80 slidably contacts with the inner peripheral wall 701 of the piston guide cylinder 70 along the axial direction. Thus, the piston 80 is guided by the piston guide cylinder 70 such that the piston 80 can reciprocate in the axial direction. The pressurization chamber 202 is defined by the end of the piston 80 on the lid member 50 side, the lid member 50 and the inner peripheral wall 701 of the piston guide cylinder 70.

A second compression coil spring 62 as a second biasing member is provided around the outer peripheral side of the piston guide cylinder 70. An end of the second compression coil spring 62 contacts with the piston guide cylinder 70, and the other end of the second compression coil spring 62 contacts with the flange section 85 of the piston 80. The second compression coil spring 62 biases the piston 80 in a direction opposite from the lid member 50, i.e., in a direction increasing the volume of the pressurization chamber 202. If the piston 80 moves in the direction increasing the volume of the pressurization chamber 202 due to the biasing force of the second compression coil spring 62, the pressure of the pressurization chamber 202 decreases.

The piezo driver 90 is provided on a side of the piston 80 opposite from the lid member 50. The piezo driver 90 is formed substantially in the shape of a circular column. An end 901 of the piezo driver 90 is fixed to an inner side of the nozzle body 20 opposite from the injection hole 21. A fuel chamber 104 is formed between the outer peripheral wall of the piezo driver 90 and the inner peripheral wall of the nozzle body 20. The fuel flows from the common rail into the fuel chamber 104 via the inlet port 23.

The piezo driver 90 has a piezo stack 91. For example, the piezo stack 91 is a general one having a capacitive structure, in which piezoelectric ceramic layers such as PZT (lead zirconate titanate) and electrode layers are stacked alternately. The piezo driver 90 is energized according to a command from an ECU (not shown). The piezo stack 91 extends in the axial direction when an electric energy is charged to the piezo stack 91 by the command of the ECU. When the electric energy is discharged from the piezo stack 91, the piezo stack 91 contracts in the axial direction.

The pushing member 95 is provided on the piston 80 side of the piezo stack 91. The pushing member 95 has a projecting section 96 in the shape of a rod on the piston 80 side thereof. A tip 961 of the projecting section 96 contacts with the bottom wall 83 of the piston 80 at a contact point P1. The contact point P1 substantially coincides with the centroid G1 of the piston 80. If the piezo stack 91 extends, the tip 961 of the pushing member 95 pushes the piston 80 toward the lid member 50, i.e., in a direction decreasing the volume of the pressurization chamber 202, against the biasing force of the second compression coil spring 62. If the piston 80 moves in the direction decreasing the volume of the pressurization chamber 202 when the pushing member 95 pushes the piston 80, the pressure of the pressurization chamber 202 increases.

The piston 80 is formed with a passage 86 providing communication between the fuel chamber 104 and the pressurization chamber 202. A check valve 87 is provided in the passage 86. The check valve 87 allows the flow of the fuel through the passage 86 from the fuel chamber 104 toward the pressurization chamber 202 and blocks the flow of the fuel from the pressurization chamber 202 toward the fuel chamber 104. Accordingly, when the piston 80 moves away from the lid member 50 due to the biasing force of the second compression coil spring 62, the fuel flows from the fuel chamber 104 into the pressurization chamber 202 via the passage 86. When the piezo driver 90 pushes the piston 80 and the piston 80 moves toward the lid member 50, the outflow of the fuel from the pressurization chamber 202 to the fuel chamber 104 is restricted, and the pressure of the pressurization chamber 202 increases.

A communication passage 203 for providing communication between the pressurization chamber 202 and the pressure control chamber 201 is formed in the lid member 50 and the needle guide cylinder 40. Thus, the fuel in the pressurization chamber 202 flows into the pressure control chamber 201, and the fuel pressure in the pressure control chamber 201 substantially coincides with the fuel pressure in the pressurization chamber 202. Therefore, if the fuel in the pressurization chamber 202 is pressurized, the fuel pressure in the pressure control chamber 201 increases correspondingly.

An outer peripheral flow passage 103 is defined between the outer peripheral walls of the needle guide cylinder 40, the lid member 50, the piston guide cylinder 70 and the piston 80 and the inner peripheral wall of the nozzle body 20. The fuel chamber 104, the outer peripheral flow passage 103, the passage 52, the back pressure chamber 102, the hollow 32 and the fuel sump chamber 101 communicate with each other and constitute the fuel passage 100.

The above-described pressure control chamber 201, the communication passage 203 and the pressurization chamber 202 constitute a fuel pressure control system.

Next, an operation of the fuel injection device 1 according to the present embodiment will be explained with reference to FIG. 1. When the piezo stack 91 is not charged, the piezo stack 91 is contracted. When the piezo stack 91 is contracted, the fuel passage 100, the pressurization chamber 202, the pressure control chamber 201 and the communication passage 203 are filled with the fuel. The pressure in the pressurization chamber 202, the pressure control chamber 201 and the communication passage 203 is equivalent to the pressure in the fuel passage 100. At this time, the needle 30 is seated on the valve seat 22 due to the biasing force of the first compression coil spring 61. Therefore, the communication between the fuel sump chamber 101 and the injection hole 21 is blocked, and the fuel injection from the injection hole 21 is stopped.

If the charge of the piezo stack 91 is started, the piezo stack 91 extends in the axial direction. Thus, the pushing member 95 pushes the piston 80 toward the lid member 50, i.e., in the direction decreasing the volume of the pressurization chamber 202, against the biasing force of the second compression coil spring 62. As a result, the fuel in the pressurization chamber 202 is pressurized. If the fuel in the pressurization chamber 202 is pressurized, the pressure of the fuel in the pressure control chamber 201 communicating with the pressurization chamber 202 via the communication passage 203 increases. The pressure in the pressure control chamber 201 acts on the wall surfaces of the needle 30, the nozzle body 20 and the needle guide cylinder 40 defining the pressure control chamber 201. Therefore, if the fuel pressure in the pressure control chamber 201 increases, the needle 30 lifts in an axial direction opposite from the valve seat 22 against the biasing force of the first compression coil spring 61 and separates from the valve seat 22. Thus, the fuel flows from the common rail into the fuel sump chamber 101 via the inlet port 23, the fuel chamber 104, the outer peripheral flow passage 103, the passage 52, the back pressure chamber 102 and the hollow 32. If the needle 30 separates from the valve seat 22, the fuel sump chamber 101 communicates with the injection hole 21, and the fuel is injected from the injection hole 21.

Then, if the discharge of the piezo stack 91 is started, the piezo stack 91 contracts in the axial direction. Thus, the pushing member 95 pushing the piston 80 moves in the direction opposite from the piston 80. At this time, the piston 80 moves toward the piezo driver 90, i.e., in the direction increasing the volume of the pressurization chamber 202, due to the biasing force of the second compression coil spring 62. As a result, the pressure of the fuel in the pressurization chamber 202 decreases and the fuel flows from the fuel chamber 104 into the pressurization chamber 202 via the passage 86. If the pressure of the fuel in the pressurization chamber 202 decreases, the pressure of the fuel in the pressure control chamber 201 communicating with the pressurization chamber 202 also decreases. At this time, the needle 30 moves toward the valve seat 22 due to the biasing force of the first compression coil spring 61 and is seated on the valve seat 22. Thus, the fuel passage 100 communicating with the injection hole 21 is blocked, and the fuel injection from the injection hole 21 ends.

Figure 2:
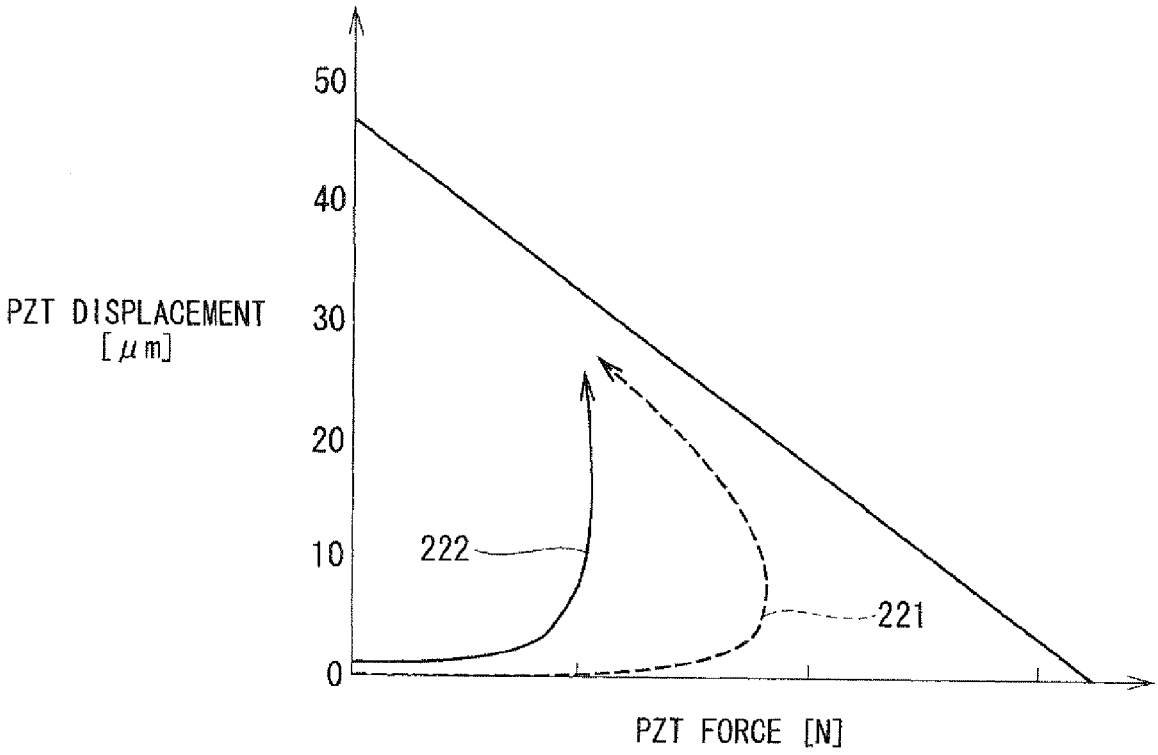
FIG. 2 is a characteristic diagram showing a characteristic of the fuel injection device according to the first embodiment.

FIG. 2 is a diagram showing a relationship between a PZT generation force generated by the PZT (referred to as a PZT force, hereafter) and PZT displacement in each of cases of the fuel injection device 1 according to the present embodiment and a fuel injection device of a comparative example. The horizontal axis shows the PZT force and the vertical axis shows the PZT displacement. The fuel injection device 5 of the comparative example shown in FIG. 5 does not have a cavity in a piston 580. Accordingly, as shown by a broken line 221 in FIG. 2, the PZT displacement does not occur unless the PZT force becomes large. Therefore, an energy loss is large. As contrasted thereto, since the fuel injection device 1 according to the present embodiment is formed with the cavity 84 in the piston 80, as shown by a solid line 222 in FIG. 2, the PZT force necessary to cause the PZT displacement is smaller than in the case of the fuel injection device 5 of the comparative example. That is, the energy loss of the fuel injection device 1 according to the present embodiment is smaller than that of the fuel injection device 5 of the comparative example.

Figure 5:
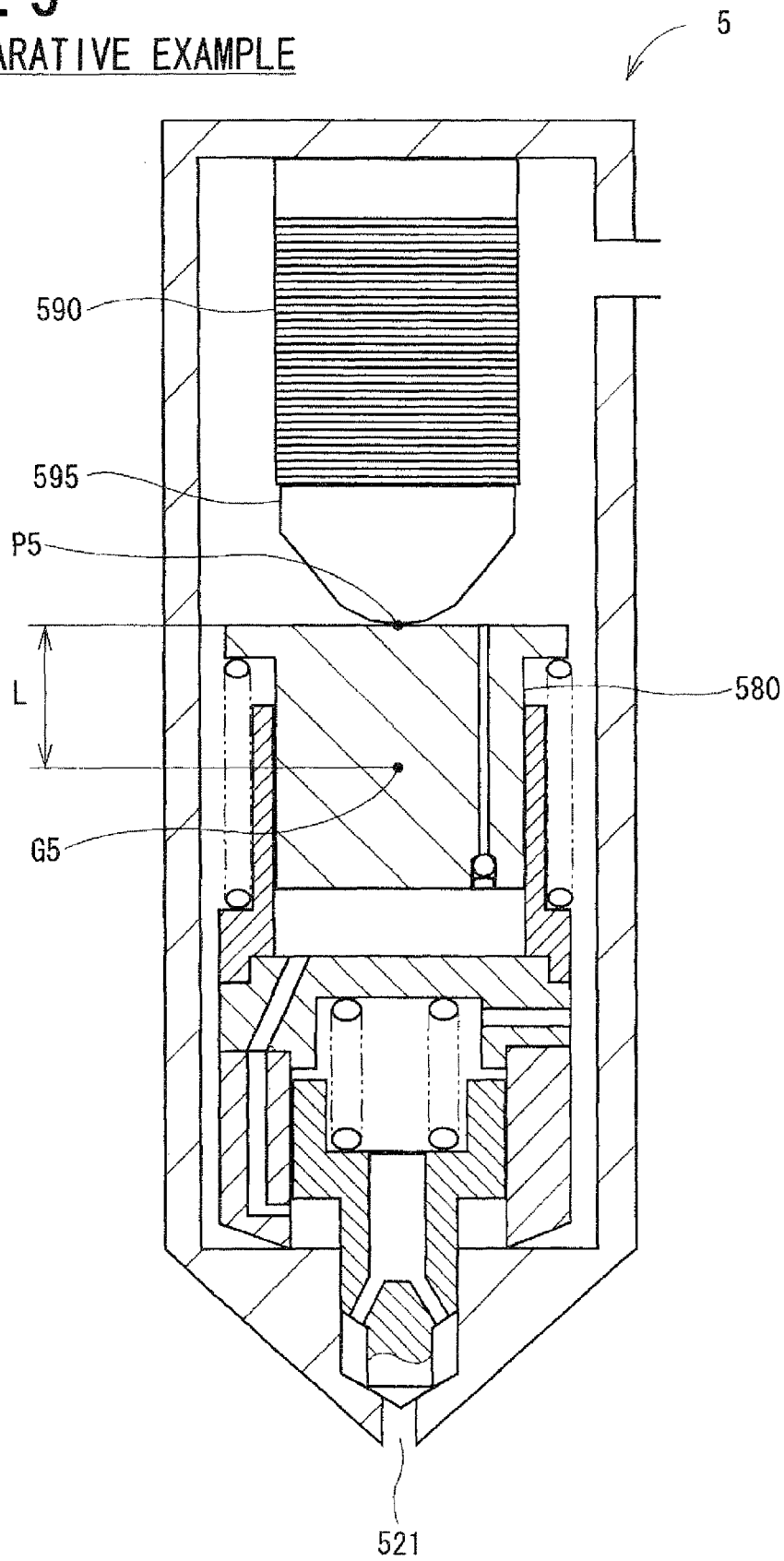
FIG. 5 is a schematic sectional diagram showing a fuel injection device of a comparative example.

In addition, as shown in FIG. 5, in the fuel injection device 5 of the comparative example, a contact point P5 between a pushing member 595, which is provided on a piston 580 side of a piezo driver 590, and the piston 580 is located on a side of the centroid G5 of the piston 580 opposite from an injection hole 521. The contact point P5 is distanced from the centroid G5 by a distance L. Therefore, the piston 580 tends to incline when the pushing member 595 pushes the piston 580. If the piston 580 inclines, a sliding resistance increases and the energy loss increases.

As contrasted thereto, as shown in FIG. 1, in the fuel injection device 1 according to the present embodiment, the contact point P1 between the piston 80 and the pushing member 95 substantially coincides with the centroid G1 of the piston 80. Accordingly, the piston 80 is less apt to incline when the piezo driver 90 pushes the piston 80. Therefore, the increase of the sliding resistance can be inhibited and the energy loss can be suppressed.

As explained above, in the fuel injection device 1 according to the present embodiment, the piston 80 has the cavity 84 defined by the inner wall 81. The movable mass is reduced in the piston 80 while securing the axial length of the sliding section between the piston 80 and the piston guide cylinder 70. Therefore, the inertial resistance is reduced and the energy loss can be reduced.

The contact point P1 between the piston 80 and the pushing member 95 substantially coincides with the centroid G1 of the piston 80. Accordingly, the piston 80 is less apt to incline when the piezo driver 90 pushes the piston 80. Therefore, the increase of the sliding resistance can be inhibited and the energy loss can be suppressed.

Second Embodiment

Figure 3:
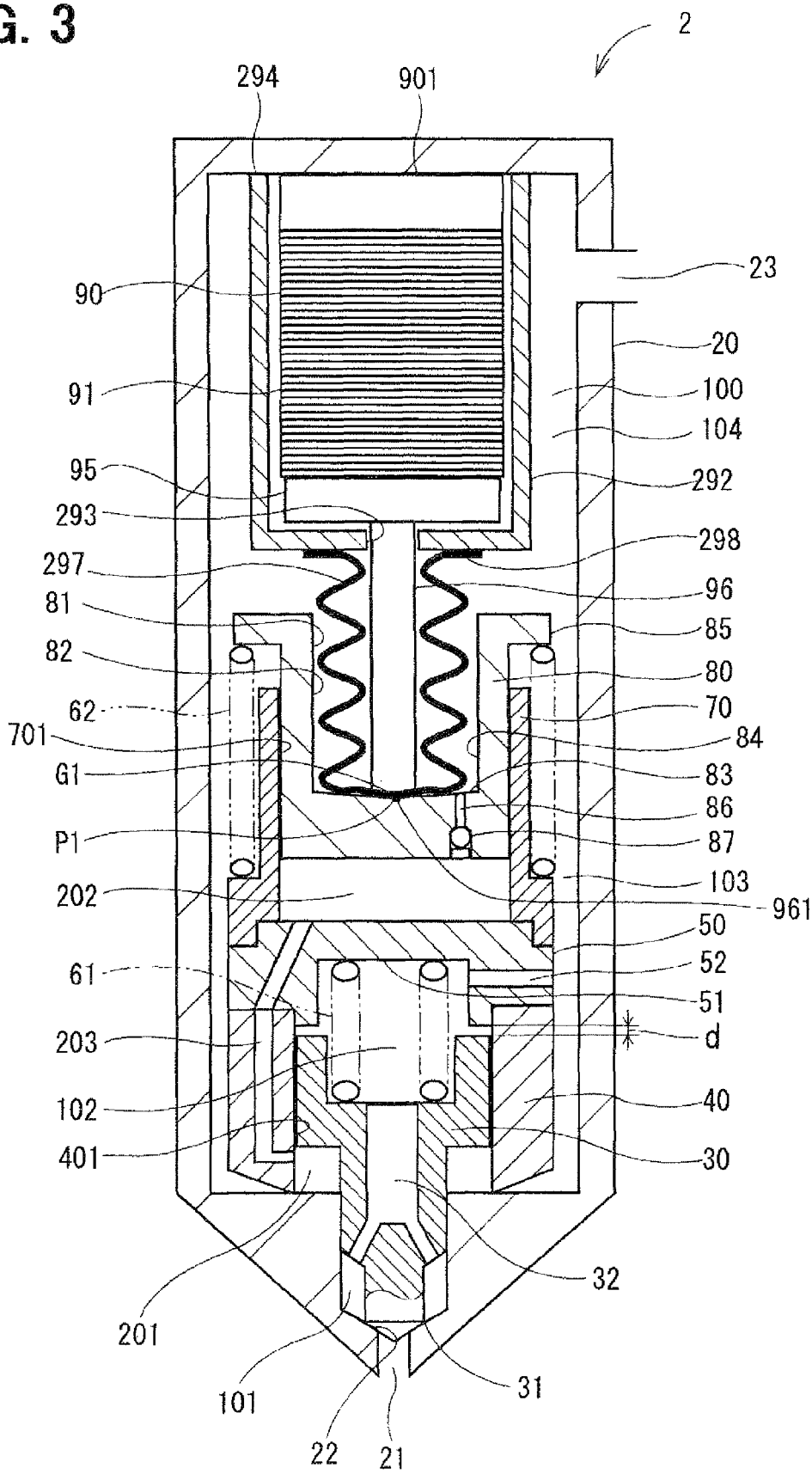
FIG. 3 is a schematic sectional diagram showing a fuel injection device according to a second embodiment of the present invention.

FIG. 3 shows a fuel injection device according to a second embodiment of the present invention. The fuel injection device 2 according to the second embodiment of the present invention has a piezo stack cover 292 as an accommodation member accommodating the piezo driver 90 inside the nozzle body 20 and a bellows 297 as a sealing member isolating the piezo driver 90 and the pushing member 95 from the fuel passage 100.

The piezo stack cover 292 is formed in a cylindrical shape. An end 294 of the piezo stack cover 292 is fixed to the inner wall of the nozzle body 20 on a side opposite from the injection hole 21. The other end of the piezo stack cover 292 has an opening 293, into which the projecting section 96 of the pushing member 95 is inserted.

The bellows 297 is formed in a bellows-like shape (accordion-like shape) to cover the outer periphery of the projecting section 96 of the pushing member 95. The bellows 297 is bonded with the piezo stack cover 292 at a sealing section 298 of the bellows 297. The tip of the projecting section 96 of the pushing member 95 contacts with the bellows 297 and pushes the piston 80 through the bellows 297. The bellows 297 isolates the piezo driver 90 and the pushing member 95 from the fuel passage 100. The bellows 297 prevents the fuel from entering the inside of the bellows 297 and the piezo stack cover 292.

Thus, the fuel injection device 2 according to the present embodiment exerts the same effect as the effect of the fuel injection device 1 according to the first embodiment. Moreover, the fuel injection device 2 according to the present embodiment can maintain the inside of the bellows 297 and the piezo stack cover 292 at the low pressure to protect the piezo driver 90 from the high-pressure fuel supplied from the common rail.

Third Embodiment

Figure 4:
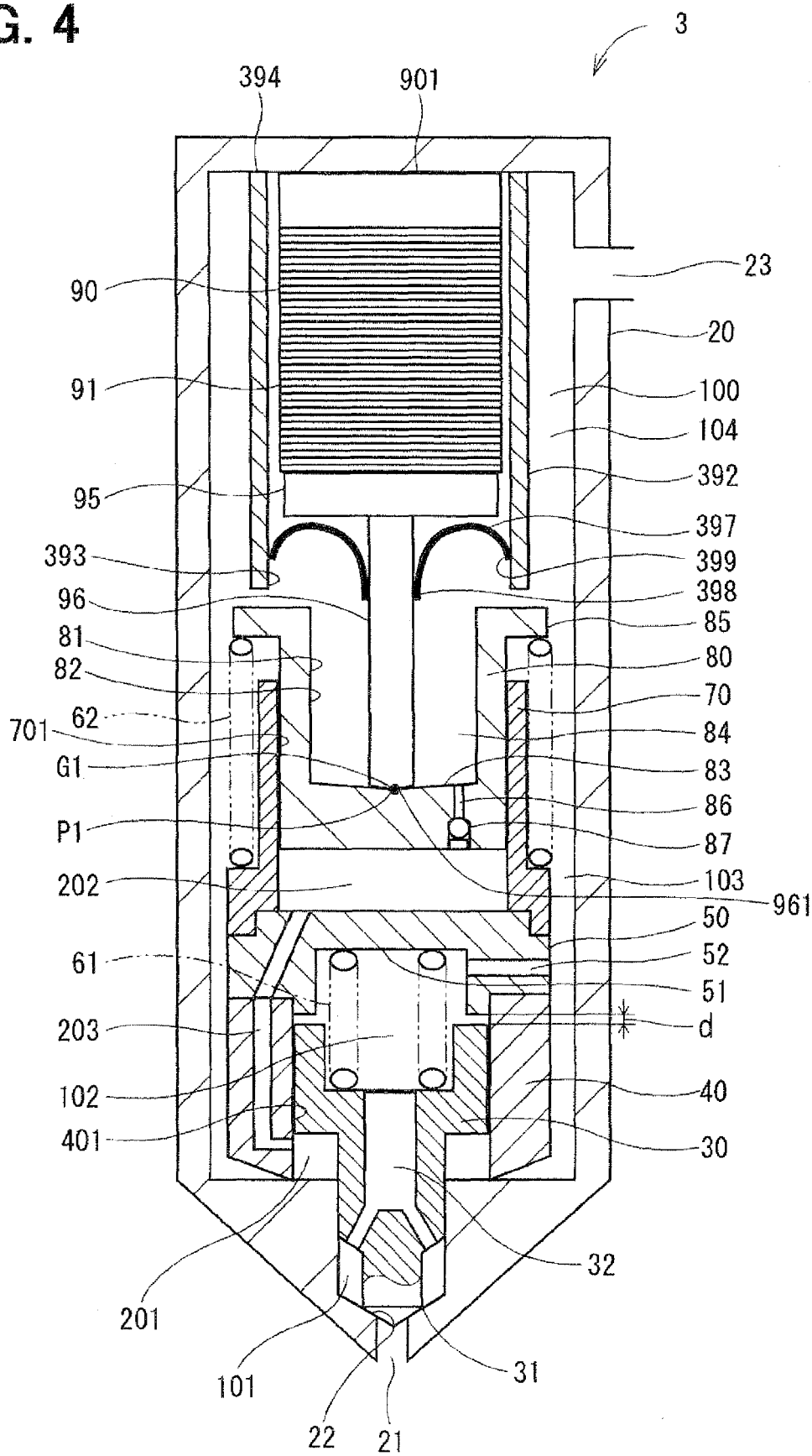
FIG. 4 is a schematic sectional diagram showing a fuel injection device according to a third embodiment of the present invention.

FIG. 4 shows a fuel injection device according to a third embodiment of the present invention. The fuel injection device 3 according to the third embodiment has a piezo stack cover 392 as an accommodation member accommodating the piezo driver 90 inside the nozzle body 20 and a diaphragm 397 as a sealing member.

The piezo stack cover 392 is formed in a cylindrical shape. An end 394 of the piezo stack cover 392 is fixed to the inner wall of the nozzle body 20 on a side opposite from the injection hole 21. The other end of the piezo stack cover 392 has an opening 393.

The diaphragm 397 is formed in an annular shape. Sealing is made between a sealing section 398 of a radially inner end of the diaphragm 397 and the outer wall of the projecting section 96 of the pushing member 95. Also, sealing is made between a sealing section 399 of a radially outer end of the diaphragm 397 and an inner peripheral wall of the piezo stack cover 392. The diaphragm 397 is formed to be able to extend and contract to allow the axial motion of the pushing member 95 due to the driving force of the piezo driver 90. The diaphragm 397 isolates the piezo driver 90 from the fuel passage 100. The diaphragm 397 prevents the fuel from entering the inside of the piezo stack cover 392.

Thus, the fuel injection device 3 according to the third embodiment exerts the same effect as the effect of the fuel injection device 1 according to the first embodiment. The fuel injection device 3 according to the third embodiment maintains the inside of the piezo stack cover 392 at the low pressure and protects the piezo driver 90 from the high-pressure fuel supplied from the common rail.

Other Embodiments

In the above description of the embodiments, the examples applying the fuel injection device according to the present invention to the common rail diesel engine are explained. Alternatively, as other embodiments, the present invention may be applied to other types of diesel engine or gasoline engine.

In the above description of the embodiments, the examples using the piezo stack as the driver are explained. Alternatively, as other embodiments, the present invention may be applied by using an other type of driver, which changes its displacement in accordance with the supplied power, such as an electrostrictive element, a magnetostrictive element or a linear solenoid.

In the above-described embodiments, the pushing member pushes the piston at the position substantially coinciding with the centroid of the piston. Alternatively, as other embodiments of the present invention, the pushing member may push the piston at a position on the injection hole side of the centroid of the piston. If the pushing position is on the injection hole side of the centroid of the piston, the inclination of the piston can be inhibited and the similar effect can be exerted.

In the above description of the embodiments, the example using the bellows or the diaphragm as the sealing member is explained. Alternatively, as other embodiments of the present invention, any kind of apparatus may be used as the sealing member as long as the apparatus can prevent the fuel from entering the piezo driver. Specifically, a sealing member capable of bearing the high fuel pressure is preferable.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A fuel injection device comprising:

a nozzle body having an injection hole, a valve seat and a fuel passage communicating with the injection hole;

a valve member that blocks fuel flowing through the injection hole when the valve member is seated on the valve seat and that allows the flow of the fuel when the valve member separates from the valve seat;

a first biasing member that biases the valve member in a valve-closing direction;

a cylinder member accommodated in the nozzle body;

a piston capable of reciprocating in the cylinder member in an axial direction;

a fuel pressure control system having a pressure control chamber, which biases the valve member in a valve-opening direction against the biasing force of the first biasing member when pressure of a fuel in the pressure control chamber increases, and a pressurization chamber communicating with the pressure control chamber, the fuel in the pressurization chamber being pressurized by the piston;

a second biasing member that biases the piston in a direction decreasing the pressure of the pressurization chamber;

a driver having a first end fixed to the nozzle body and a second end capable of displacing in accordance with an energization amount to the driver;

a pushing member that is provided at the second end of the driver, that has a projecting section in a rod shape on a piston side, and that pushes the piston in a direction increasing the pressure in the pressurization chamber by using the driving force of the driver against the biasing force of the second biasing member;

an accommodation member in a cylindrical shape that accommodates the driver inside the nozzle body, the accommodation member having an opening into which the pushing member is inserted; and a sealing member formed separately from the accommodation member and bonded at a bottom of the accommodation member to isolate the driver and the pushing member from the fuel passage, wherein the sealing member is a bellows;

wherein the piston has a cavity on the driver side, and the pushing member pushes an inner wall of the piston defining the cavity, and the sealing member is formed to cover an outer periphery of the projecting section that projects from the opening, and is provided, together with the projecting section, inside of the cavity that is defined by an inner wall of the piston that is substantially in a cylindrical shape having a bottom.

2. The fuel injection device as in claim 1, wherein the pushing member pushes the piston at a position substantially coinciding with the centroid of the piston.

3. The fuel injection device as in claim 1, wherein the pushing member pushes the piston at a position on the injection hole side of the centroid of the piston.

* * * * *